US006181904B1

(12) United States Patent
Burdette et al.

(10) Patent No.: US 6,181,904 B1
(45) Date of Patent: Jan. 30, 2001

(54) TONER CARTRIDGE WITH PRE-DOCTORING COMMINUATOR

(75) Inventors: Chris Anthony Burdette; Jerry Wayne Calia; Alan Stirling Campbell; Todd Lucas Janes; Benjamin Keith Newman, all of Lexington, KY (US)

(73) Assignee: Lexmark International, Inc., Lexington, KY (US)

( * ) Notice: Under 35 U.S.C. 154(b), the term of this patent shall be extended for 0 days.

(21) Appl. No.: 09/511,088

(22) Filed: Feb. 23, 2000

(51) Int. Cl.[7] ..... G03G 15/08

(52) U.S. Cl. ..... 399/260; 399/284; 399/274; 118/261

(58) Field of Search ..... 399/260, 274, 399/284; 118/261

(56) References Cited

U.S. PATENT DOCUMENTS 5,331,378 7/1994 Baker et al. .
5,337,032 8/1994 Baker et al. .
5,875,378 2/1999 Campbell et al. .

FOREIGN PATENT DOCUMENTS 61-156168 * 7/1986 (JP) .

* cited by examiner

*Primary Examiner*—Richard Moses
(74) *Attorney, Agent, or Firm*—John A. Brady

(57) ABSTRACT

A toner cartridge has a comminuator that prevents the buildup of toner behind the doctor blade that meters the toner delivered to the developer roller for later image development and printing. The comminuator is mounted to, and for movement with, an agitator adjacent to an exit port of the toner hopper. A paddle that rotates within the toner hopper contacts the agitator and generates joint movement of the agitator and comminuator. The comminuator comprises a plurality of spaced blades held by a coupler mounted to the agitator. Alternatively, the comminuator comprises a wire mounted in opposing connectors mounted to the agitator.

14 Claims, 6 Drawing Sheets

TONER CARTRIDGE WITH PRE-DOCTORING COMMINUATOR

TECHNICAL FIELD

This invention relates to electrophotographic development and, more particularly, relates to a toner cartridge having an image developer to which toner is delivered with the operative assistance of a toner comminuator.

BACKGROUND OF THE INVENTION

The assignee of this invention has manufactured and sold toner cartridges of two different general designs. For its larger laser printers, the cartridge has contained a pump to meter toner of the kind disclosed in U.S. Pat. Nos. 5,012,289 to Aldrich et al. and 5,101,237 to Molloy, while the external structure of the cartridge is as disclosed in U.S. Pat. No. 5,136,333 to Craft et al. Details of other elements in the cartridge have varied.

For its smaller laser printers, the cartridge is as disclosed in U.S. Pat. No. 5,337,032 to Baker et al., which has a toner hopper extending well below a level having the toner adder roller and which has independent driven systems for the photoconductor roller and for the developer roller system as disclosed in U.S. Pat. No. 5,331,378 to Baker et al.

Further improvements to these cartridges have involved, inter alia, a hopper exit agitator, such as is shown and described in U.S. Pat. No. 5,875,378 to Campbell et al.

To meter the toner that is used to create the electrophotographic image in these smaller laser printers, a doctor blade is positioned to contact the developer roller and create a nip therebetween. The toner is delivered to the doctoring nip for placement on the developer roller. The doctor blade controls the amount of toner that reaches the developer roller by allowing only a thin layer of toner particles through the doctoring nip.

It can be appreciated by those skilled in the art that, in this operation, the toner tends to accumulate behind the doctor blade. The toner becomes packed, interfering with the intended flow thereof to the developer roller. This leads to starvation at the doctoring nip. Furthermore, the packed toner can become fused to the working surface of the doctor blade due to heat and/or pressure caused by the heavy packing of the toner itself. The ultimate result is the emergence of problems with print quality.

There is thus identified a need of preventing the accumulation of toner behind the doctor blade.

SUMMARY OF THE INVENTION

It is thus an object of the present invention to prevent the accumulation of toner behind the doctor blade as it is being delivered to the developer roller.

It is a further object of the present invention to allow a sufficient amount of toner to be delivered to the developer roller to sustain efficient printing.

Another object of the present invention is to provide uniform metering and charging of the toner as it proceeds through the doctoring nip.

It is an additional object of the present invention to prevent an obstruction to the movement of the toner that is rejected by the doctor blade.

It is yet another object of the present invention to prevent the fusion of toner onto the working surface of the doctor blade.

It is still an additional object of the present invention to prevent the doctor blade from losing its conductivity.

Additional objects, advantages and other novel features of the invention are set forth in part in the description that follows and in part are discernable by those skilled in the art upon examination of the following or become apparent with the practice of the invention. The objects and advantages of the invention are realized and obtained by means of the instrumentalities and combinations particularly pointed out in the appended claims.

To achieve the foregoing and other objects and in accordance with the purposes of the present invention described herein, a novel toner cartridge having the ability to ameliorate the problems associated with toner accumulation adjacent the doctoring nip is disclosed. In its broadest aspects, the inventive toner cartridge comprises a toner reservoir and a developer in communication with the reservoir and positioned to receive toner therefrom. A common term for the toner reservoir is "hopper" and is used interchangeably herein. A regulator is in operative association with the developer. For purposes of this application, a regulator is defined to mean any device or element to which a flow of toner particles is introduced and which acts to regulate and meter the amount of toner particles delivered to the developer. A comminuator is in operative association with the regulator. For purposes of this application, a comminuator is defined to mean any device or element that acts to separate and break up a packed mass of toner particles.

In the preferred embodiment, the regulator takes the form of a doctor blade. The comminuator acts at a pre-doctoring area, i.e. just in advance of the nip formed by the proximity of the doctor blade and the developer, to prevent the accumulation of toner adjacent to the doctor blade. In accordance with an existing design of cartridges manufactured by the assignee, the inventive cartridge has an exit port associated with the hopper and a development sump downstream from the hopper exit port. A hopper exit agitator is mounted for operation in the transition area from the exit port to the development sump. The hopper exit agitator prevents the buildup of toner in the transition area and development sump.

A particular preferred cartridge design has the comminuator mounted to the hopper exit agitator. This mounting of the comminuator allows it to oscillate with the hopper exit agitator. Incorporating elements from prior art designs, the cartridge also comprises a paddle mounted for rotation within the hopper to contact the hopper exit agitator and cause the oscillating movement of the hopper exit agitator/comminuator assembly.

A preferred embodiment of the comminuator comprises a plurality of spaced blades mounted for movement along a surface of the regulator. Desirably, one of the spaced blades is joined to a next adjacent one of the spaced blades by at least one connecting rib. At least one of the spaced blades is preferably held by a coupler mounted the hopper exit agitator.

In an alternate embodiment, the comminuator comprises a wire that is mounted for movement along a surface of the regulator. Preferably, each end of the wire is received within opposing connectors mounted to the hopper exit agitator.

Still other objects of the present invention will become apparent to those skilled in this art from the following description wherein there is shown and described a preferred embodiment of this invention, simply by way of illustration of a number of the modes best suited to carry out the invention. As will be realized, the invention is capable of other different embodiments and its several details are capable of modification in various, obvious aspects all without departing from the invention. Accordingly, the drawings and descriptions are regarded as illustrative in nature and not as restrictive.

BRIEF DESCRIPTION OF THE DRAWING

The accompanying drawing, incorporated in and forming a part of the specification, illustrates several aspects of the present invention and together with the description serves to explain the principles of the invention. In the drawing.

Reference is now made in detail to the present preferred embodiments of the invention, examples of which are illustrated in the accompanying drawing.

DETAILED DESCRIPTION OF THE INVENTION

An inventive toner cartridge 10 is disclosed that represents an improved modification of the assignee's invention embodied in U.S. Pat. No. 5,875,378 to Campbell et al. Reference is hereby made to that patent (hereinafter referred to as "the '378 patent"), the disclosure of which is incorporated by reference herein.

Figure 1:
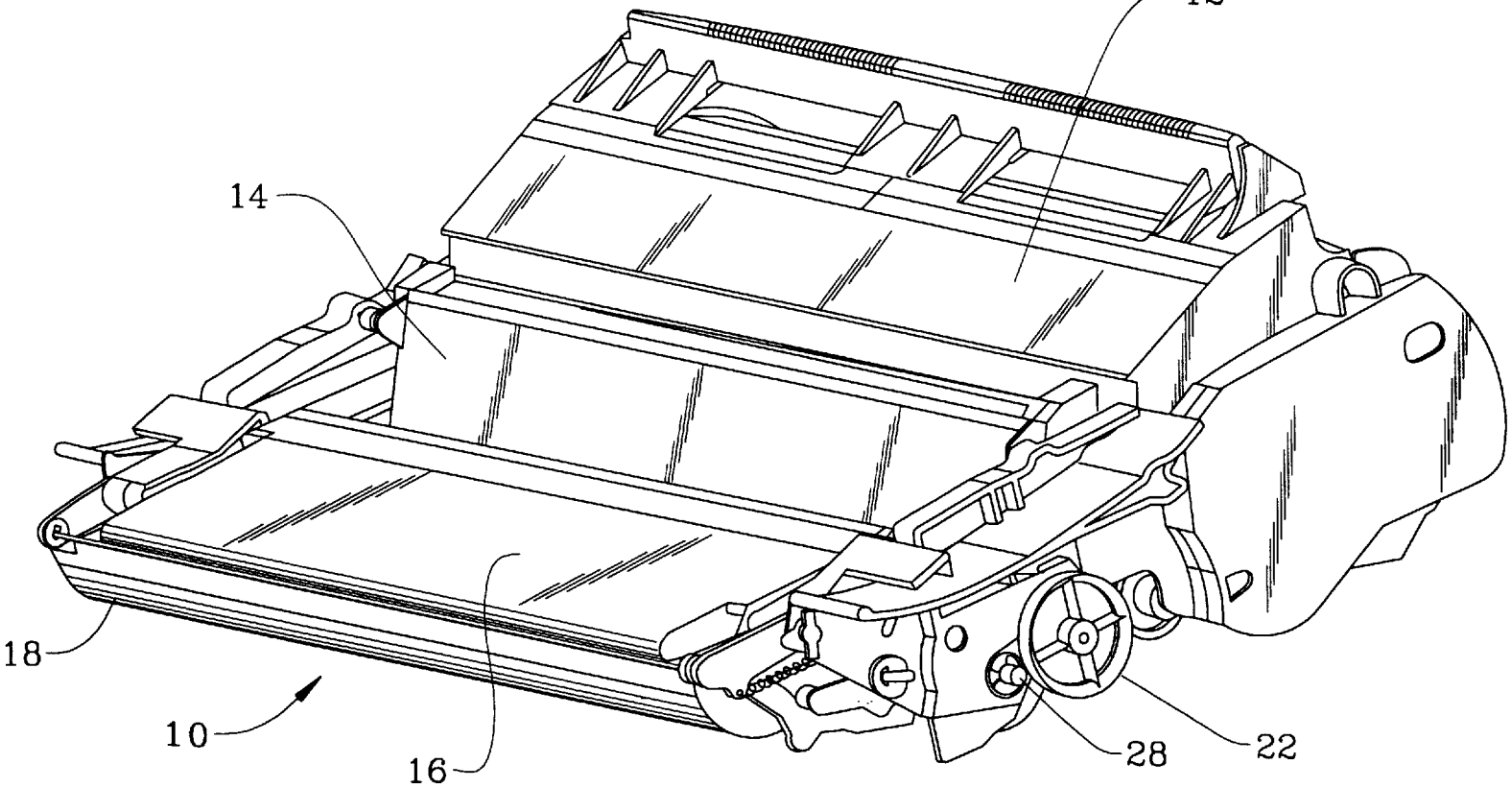
FIG. 1 is a perspective view of a fully assembled toner cartridge having internal components in accordance with the present invention.

The toner cartridge 10 is a self-contained unit removably positioned within an electrophotographic printer. The cartridge 10 is shown in FIG. 1 in its assembled configuration. Since many of the features seen in FIG. 1 are described in the '378 patent, only those that are of particular relevance to the understanding of the invention embodied in this application are mentioned in the next two paragraphs.

The inventive toner cartridge 10 has a front cover 12, an upper shutter 14, a rear cover 16 and a lower shutter 18. The front cover 12 is situated above a toner hopper 20 that is more fully described below.

A coupler 22 receives a drive element from a printer which contains an Oldham coupler to rotatably drive a developer roller 24 (not shown in FIG. 1) and a toner adder roller 26 (also not shown in FIG. 1). To the rear of the coupler 22 is a shaft 28 of a photoconductor drum 30 (drum not shown in FIG. 1).

Figure 2:
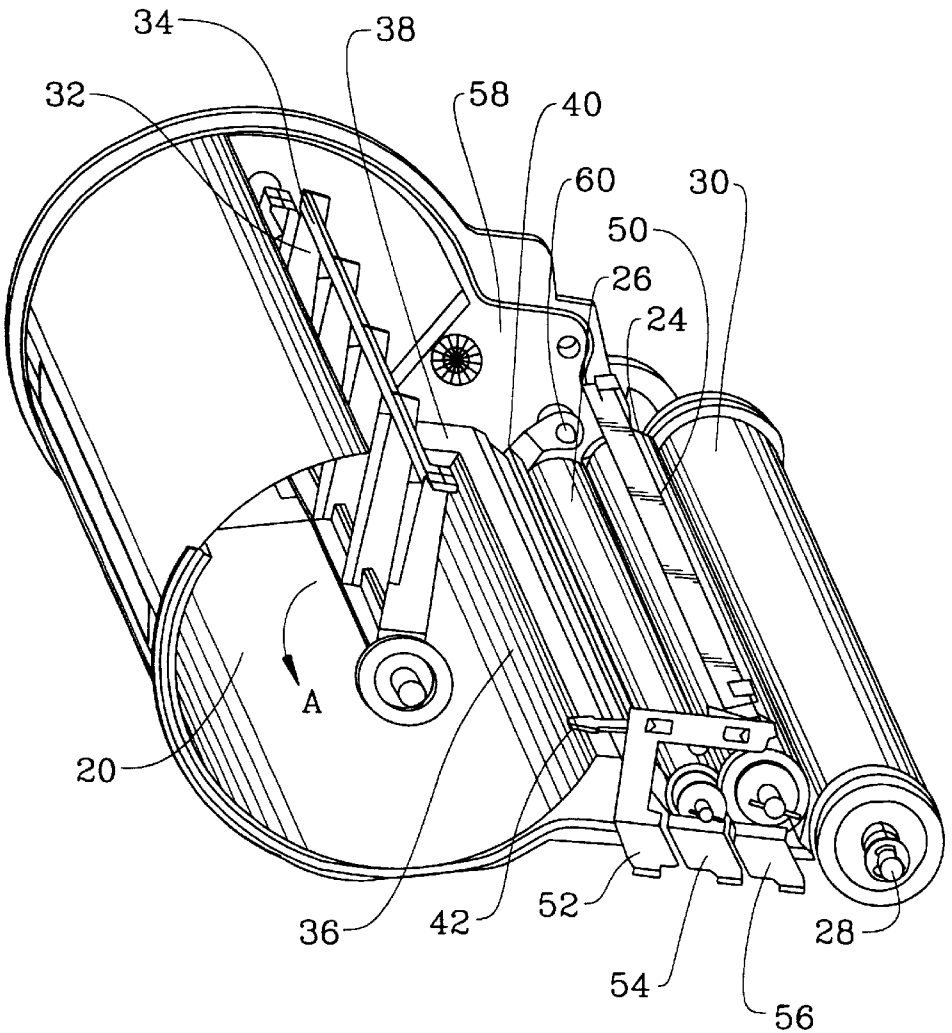
FIG. 2 is a partial cut-away perspective view of the components of the inventive cartridge that deal with the delivery of toner and development of the image for electrophotographic printing.
Figure 6:
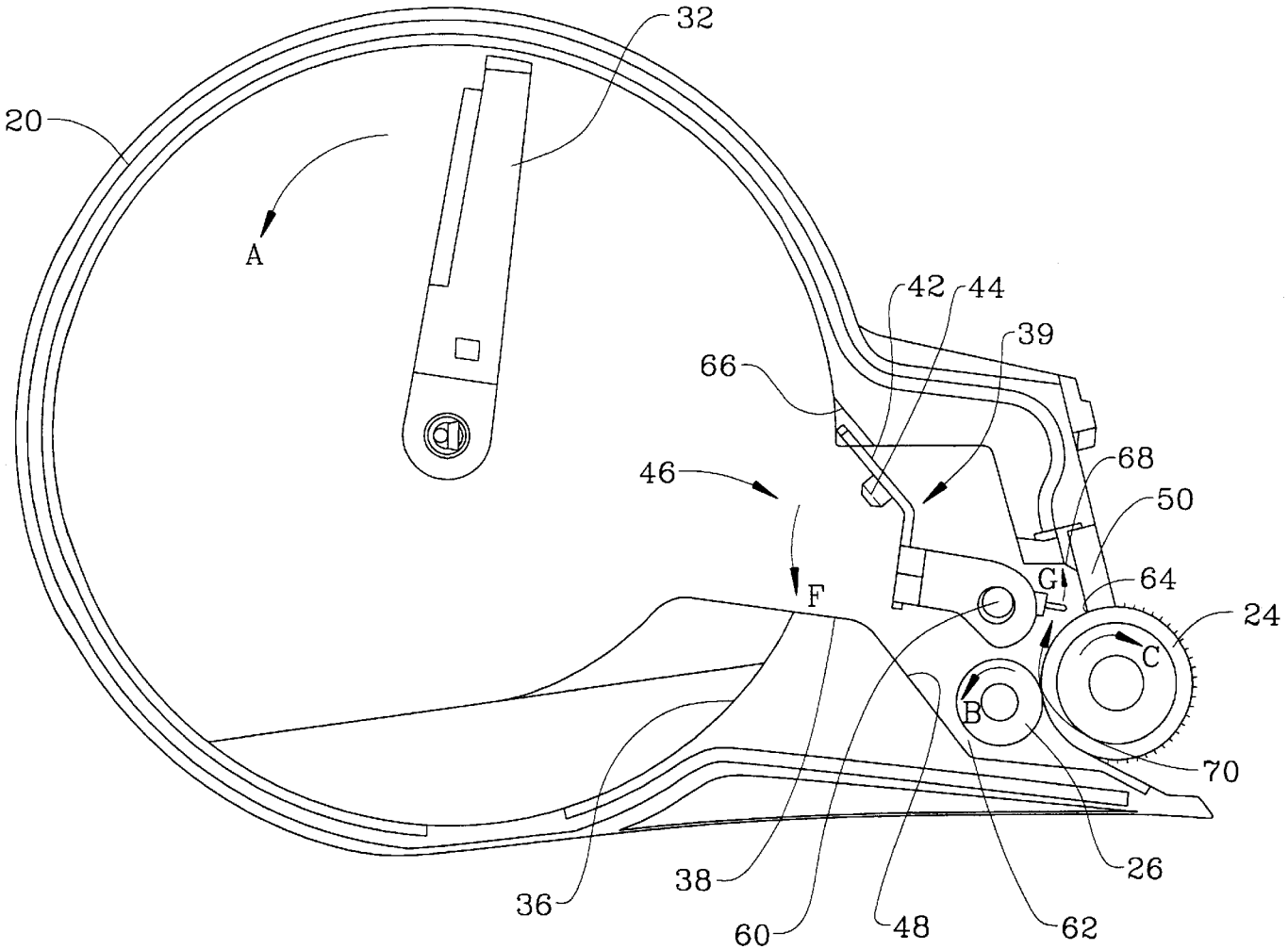
FIG. 6 is a partial cut-away side view of the components of a second embodiment of the inventive toner cartridge that house and deliver the toner and develop the image therefrom for electrophotographic printing.
Figure 7:
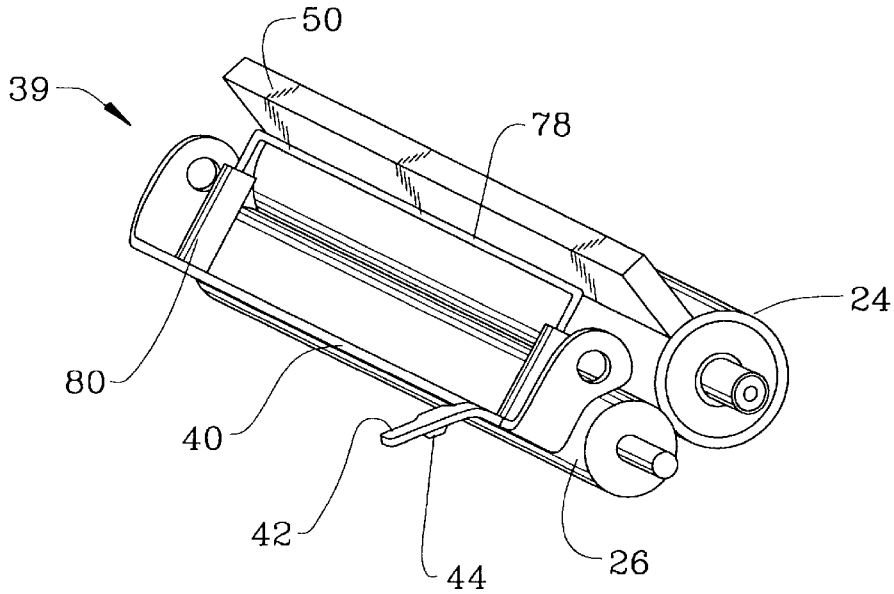
FIG. 7 is a perspective view of several of the components of a second embodiment of the present invention shown in FIG. 6.

FIG. 2 is a perspective view from above and the left front of the cartridge 10, with the top removed to show internal components. At the immediate front is a large, cylindrical toner hopper 20, having a paddle 32, which, during operation, is rotated counterclockwise in accordance with action arrow A in FIG. 2. The paddle 32 has an outer toner moving bar 34, which extends substantially across the width of the hopper 20. The hopper 20 has a rear wall 36 that terminates at about one-third of the total height of the hopper (see FIGS. 3 and 6) as a flat surface 38.

In order to assist in the delivery of toner from the hopper 20, a hopper exit agitator 39 having a sweep bar 40 is mounted at a downstream position from the hopper. The sweep bar 40 has an extension 42 that cooperates with the paddle 32 as is described below. The extension 42 has a depending tab 44 (see FIGS. 3 and 6) which rests on the surface 38 of the wall 36 when the extension is in its lowermost position. The extension 42 extends past the wall 36 into the cavity of the hopper 20 to allow contact with the bar 34 of the paddle 32 as the paddle rotates. As again can best be seen in FIGS. 3 and 6, after the bar 34 of the paddle 32 urges toner from the hopper 20 through an exit port 46, the toner travels along an intermediate surface 48 that is preferably designed and built to be approximately 50 degrees from vertical.

A solid steel-bar doctor blade 50 extends parallel with and in pressure contact with the developer roller 24. The doctor blade 50 preferably contacts the roller 24 at about 20 degrees from the vertical toward toner adder roller 26 (see FIGS. 3 and 6). Also shown in FIG. 2 are a metal electrical contact 52 to the doctor blade 50, a metal electrical contact 54 to the toner adder roller 26 and a metal electrical contact 56 to the developer roller 24. The outer ends of the contacts 52, 54, 56 bear against metal contacts in the printer when the cartridge 10 is installed and are thereby able to receive electrical potentials from the printer. The applied electrical potentials create the necessary and proper charge to the blade 50, toner adder roller 26 and developer roller 24 for carriage and delivery of toner to achieve effective image development for printing.

Figure 3:
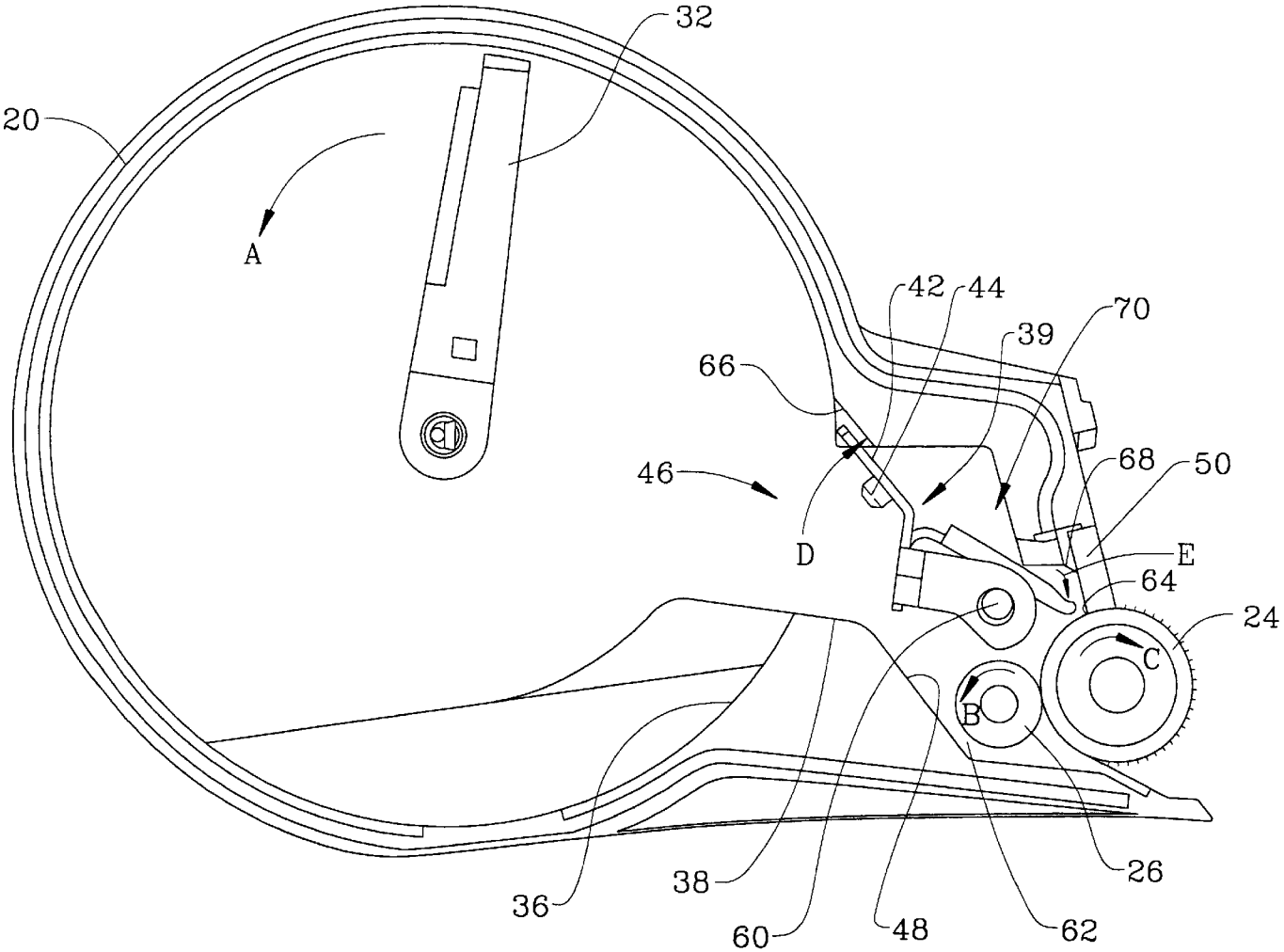
FIG. 3 is a partial cut-away side view of the components of a first embodiment of the inventive toner cartridge that house and deliver the toner and develop the image therefrom for electrophotographic printing.
Figure 4:
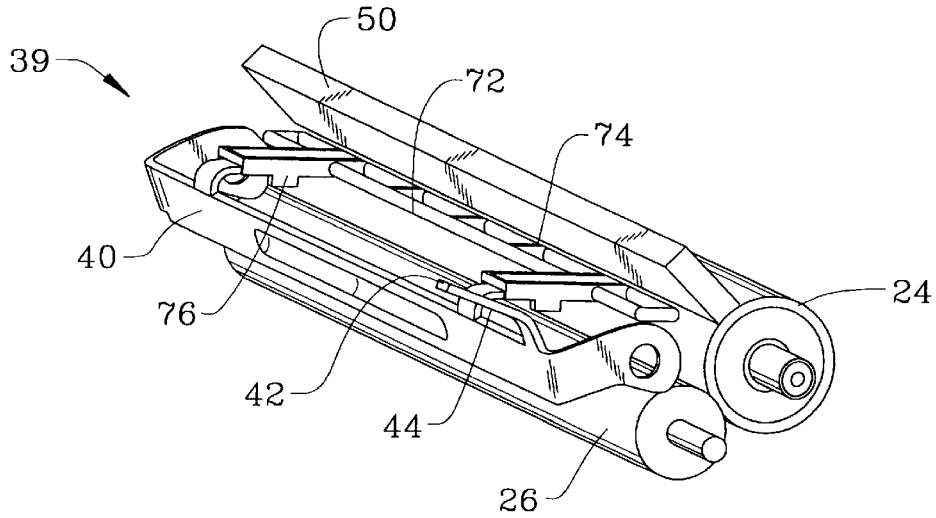
FIG. 4 is a perspective view of several of the components of the first embodiment of the present invention shown in FIG. 3.

Referring more extensively now to FIG. 3, where the image delivery and development components are shown with greater clarity, the angle of the intermediate surface 48 is easily seen. The intermediate surface 48 transitions into an area generally described as the development sump 62. Toner moves from the hopper 20 as described above to the development sump 62 where it is collected on the surface of the toner adder roller 26. The toner adder roller 26 is in contact with, and thus delivers toner to, the developer roller 24. More particularly, the toner adder roller 26 rotates in a counterclockwise direction in accordance with action arrow B. The toner adder roller 26 gathers toner and carries it to its contact point with the developer roller 24. Toner particles are there transferred to the developer roller 24. In this illustrated view, the developer roller 24 rotates in a clockwise direction as indicated by action arrow C. The toner particles are then carried into a nip 64 at the location where the doctor blade 50 contacts the developer roller 24. The doctor blade 50 acts as the regulator of the preferred embodiment. In operation, the blade 50 meters the proper amount of toner to remain on the developer roller 24 as it rotates into engagement with the photoconductor drum 30 (not shown). As is known in the art, the drum 30 has a latent image thereon to which the toner adheres, creating an image for printing.

The developing system of cartridge 10 is essentially very similar to that of the Optra brand family of printers sold by the assignee of this invention. As in that family of printers, the developer roller 24 is constructed of semiconductive material attached to a steel shaft and the toner adder roller 26 is a conductive sponge material attached to a steel shaft. The sponge material of the toner adder roller 26 is sufficiently porous to be capable of holding a large amount of toner. Furthermore, through the electrical contact 54, the toner adder roller 26 has a voltage bias applied to its shaft, properly charging the toner particles to facilitate their adherence to the developer roller 24 when delivered thereto by the toner adder roller. Toner is thus attractively carried to the nip 64 between the developer roller 24 and the doctor blade 50.

The toner adder roller 26 and the developer roller 24 are journaled in rearwardly extending ears 58 (see FIG. 2) of the hopper 20. The hopper exit agitator 39 is pivotally mounted by a pin 60 to the ears 58 of the hopper 20. In operation, as described above, as the paddle 32 rotates, the bar 34 contacts the extension 42, thereby lifting the sweep bar 40 to rotate around the pin 60 in a counterclockwise direction as indicated by action arrow D. The paddle bar 34 continues to carry the extension 42 upwardly until the extension enters a notch 66 cut in the surface of the hopper 20 at the upper portion of the exit port 46. At this point, the rotating paddle bar 34 disengages from the extension 42 of the sweep bar 40. The sweep bar 40 of the hopper exit agitator 39 then returns to the surface 38 of the wall 36 under the force of gravity to separate and scoop toner, which otherwise tends to accumulate along the intermediate surface 48, for carriage toward the toner adder roller 26. A more complete description of the hopper exit agitator 39 is found in a section of the '378 patent entitled "Agitator Bar System" at columns 8–10. In accordance with the instruction above, this text from the '378 patent is incorporated herein by reference.

It is important to ensure that a precise amount of toner is delivered to the developer roller 24. If insufficient toner is delivered, the resulting print image will not be dark enough. If too much toner is delivered, the excess is unusable later and thus wasted.

Furthermore, the proper amount of toner facilitates uniform charging of the particles so that they develop only into the discharged areas of the photoconductor. A low charge on the toner particles results in high background in the non-discharged areas. On the other hand, a high charge on the toner particles results in low toner development in the discharged areas of the drum.

Therefore, regulation of toner at the doctoring nip 64 results in the optimum amount being delivered to the developer roller 24. This in turn optimizes image development and print quality.

Since the toner adder roller 26 is heavily saturated with toner, large amounts of toner are supplied to the doctoring nip 64 in order to replenish those areas on the surface of the developer roller 24 where toner has previously been developed to the photoconductor. During normal printing, much of the toner is rejected by the doctor blade 50 and is not allowed to pass through the doctoring nip 64. The rejected toner tends to climb along a back surface 68 of the doctor blade 50 and accumulate over time. If the accumulating toner is not properly dealt with, it can become packed behind the doctor blade 50 and create an obstruction to the flow of subsequent toner that is rejected during the doctoring process.

The accumulation of toner and resulting obstruction to flow tends to cause two major problems. First, when the packed toner no longer allows fresh toner to reach the doctoring nip 64, the packed toner skives toner off of the developer roller 24 prior to reaching the doctoring nip 64. This results in an insufficient supply of toner passing through the doctoring nip 64, causing insufficient image development in medium and high print coverage application.

Second, the packing of toner can get severe enough to cause fusion of toner particles to the working surface of the doctor blade 50. When this happens, the surface of the doctor blade 50 can no longer maintain sufficient conductivity to charge the toner particles passing through the nip 64. The accumulation of used toner also prevents fresh toner from passing through the doctoring nip 64, resulting in starvation as described above.

In accordance with the optimal design of the inventive cartridge 10, management of toner in advance of the doctoring nip 64 minimizes the packing of toner. This in turn facilitates achievement of the desired goal of uniform metering and charging of the toner particles.

In the preferred embodiment of the present invention, this goal is accomplished through the use of a pre-doctoring comminuator 70 located directly behind the doctor blade 50. The comminuator 70 is mounted for movement up and down along the back surface 68 of the doctor blade 50. The comminuator 70 moves through any clump of toner it encounters, disrupting the clump and deaggregating the toner particles.

In the preferred design of the inventive cartridge 10, the comminuator 70 is mounted on the hopper exit agitator 39 and moves cooperatively therewith. As particularly shown in FIG. 3, the comminuator 70 moves downwardly when the sweep bar 40 of the agitator 39 moves upwardly. As a result of this coupled design, contact between the paddle bar 34 and the extension 42 of the sweep bar 40 not only initiates movement of the hopper exit agitator 39, but also movement of the comminuator 70 as well. It can be appreciated therefore that movement of both of the agitator 39 and comminuator 70 occurs once every revolution of the toner paddle 32.

At rest, the comminuator 70 is positioned near the top of the back surface 68 of the doctor blade 50 so as not to interfere with the doctoring nip 64 when the comminuator is static. When the paddle bar 34 contacts the extension 42 of the sweep bar 40, the comminuator 70 moves slowly down along the back surface 68 of the doctor blade 50 in accordance with action arrow E, stopping just short of the surface of the developer roller 24. Upon disengagement between the paddle bar 34 and the extension 42, the comminuator 70 returns very quickly to the original rest position as the sweep bar 40 descends to its rest position (note action arrows F and G in FIG. 6). It can be appreciated that the slow movement of the comminuator 70 toward the developer roller 24 and the rapid movement away from the developer roller is beneficial to efficiently break up the toner particles that become packed along the back surface 68 of the doctor blade 50.

Figure 5:
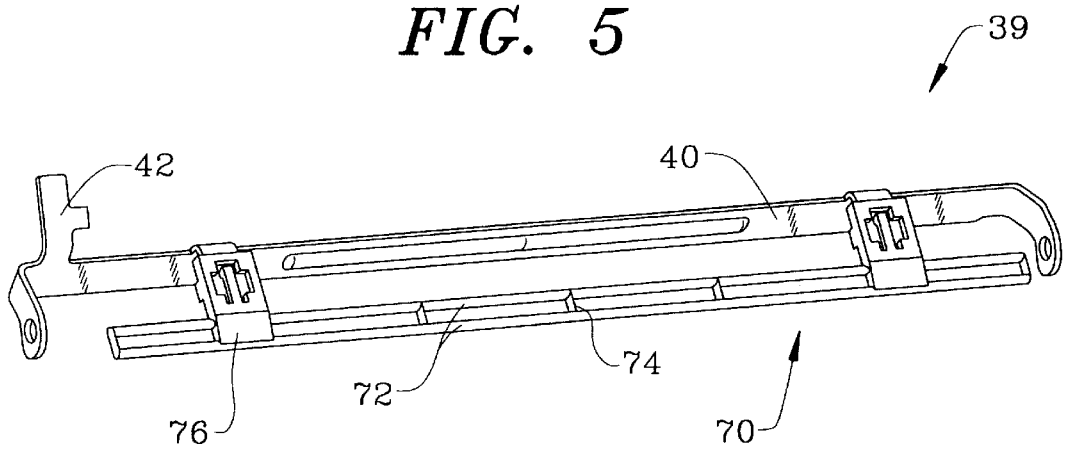
FIG. 5 is a perspective view of the hopper exit agitator and comminuator of a first embodiment of the present invention.

One preferred embodiment of the comminuator 70 is shown in FIG. 5. The comminuator 70 depicted in this embodiment comprises a plurality of spaced blades 72 mounted as a unit to the sweep bar 40 of the hopper exit agitator 39. The most preferable structure of this embodiment has two blades 72 connected by a plurality of ribs 74. While the comminuator 70 in FIG. 5 shows an end rib 74 at each end of the spaced blades 72 and three medial ribs therebetween, it is recognized that any number of ribs placed at different positions can suffice.

Preferably, the blades 72 are joined for movement with the sweep bar 40 of the hopper exit agitator 39 by a pair of couplings 76, each connected at one end to the sweep bar and capturing the blades at the other end. Here again, more or less the two couplings 76 may be used for mounting the blades 72 to the sweep bar 40.

Figure 8:
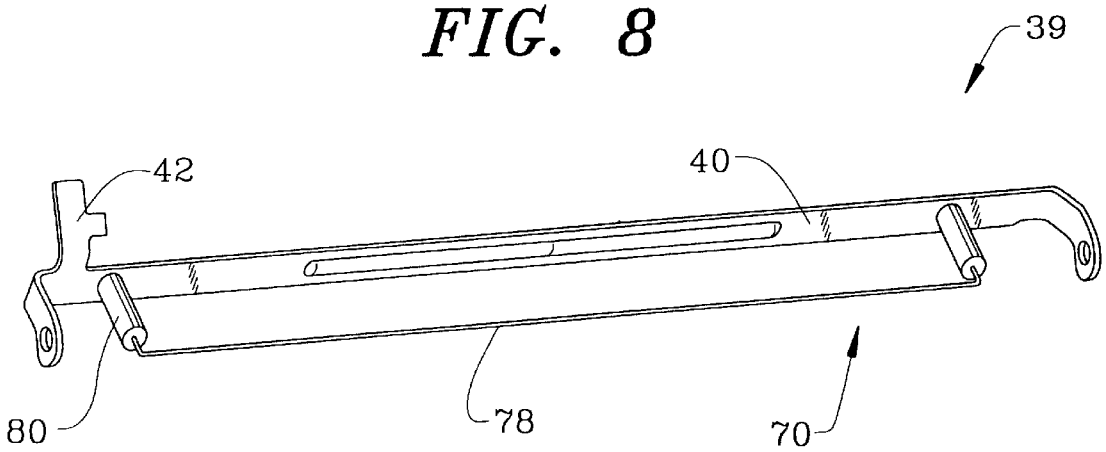
FIG. 8 is a perspective view of the hopper exit agitator and comminuator of a second embodiment of the present invention.

Another embodiment of the comminuator 70 is illustrated in FIG. 8. In this embodiment, a wire 78 is presented as the working structure. The wire 78 is bent at each end to facilitate joining with a connector 80 that in turn is mounted to the sweep bar 40 of the hopper exit agitator 39. The wire 78 is thus mounted in position to travel with the sweep bar 40 and along the back side 68 of the doctor blade 50.

The foregoing description of a preferred embodiment of the invention is presented for purposes of illustration and description. It is not intended to be exhaustive or to limit the invention to the precise form disclosed. Obvious modifications or variations are possible in light of the above teachings. The embodiment is chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

We claim:

1. A toner cartridge, comprising:

a toner reservoir;

a developer in communication with, and receiving toner from, said reservoir;

a regulator in operative association with, and for metering toner delivered to, said developer; and a comminuator in operative association with, and for preventing the accumulation of toner adjacent to, said regulator.

2. The toner cartridge as in claim 1, wherein said regulator is a doctor blade.

3. The toner cartridge as in claim 1, further comprising:

an exit port in said reservoir; and an agitator mounted adjacent to, and contacting toner passing through, said exit port.

4. The toner cartridge as in claim 3, wherein said comminuator is mounted to said agitator.

5. The toner cartridge as in claim 1, wherein said comminuator comprises a plurality of spaced blades mounted for movement along a surface of said regulator.

6. The toner cartridge as in claim 5, wherein one of said spaced blades is joined to a next adjacent one of said spaced blades by a connecting rib.

7. The toner cartridge as in claim 6, wherein at least one of said spaced blades is held by a coupler mounted to said agitator.

8. The toner cartridge as in claim 4, wherein said comminuator comprises a plurality of spaced blades mounted to said agitator.

9. The toner cartridge as in claim 8, wherein one of said spaced blades is joined to a next adjacent one of said spaced blades by a connecting rib.

10. The toner cartridge as in claim 9, wherein at least one of said spaced blades is held by a coupler mounted to said agitator.

11. The toner cartridge as in claim 1, wherein said comminuator comprises a wire mounted for movement along a surface of said regulator.

12. The toner cartridge as in claim 11, wherein each end of said wire is received within a connector mounted to said agitator.

13. The toner cartridge as in claim 4, wherein said comminuator comprises a wire mounted to said agitator.

14. The toner cartridge as in claim 13, wherein each end of said wire is received within a connector mounted to said agitator.

* * * * *